US007661513B2

(12) United States Patent
Kocher

(10) Patent No.: US 7,661,513 B2
(45) Date of Patent: Feb. 16, 2010

(54) DUAL-CAR ELEVATOR SYSTEM WITH COMMON COUNTERWEIGHT

(75) Inventor: Hans Kocher, Udligenswil (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/956,618

(22) Filed: Dec. 14, 2007

(65) Prior Publication Data

US 2008/0142308 A1 Jun. 19, 2008

Related U.S. Application Data

(60) Provisional application No. 60/870,196, filed on Dec. 15, 2006.

(30) Foreign Application Priority Data

Dec. 14, 2006 (EP) ..... 06126177

(51) Int. Cl.
*B66B 9/00* (2006.01)
*B66B 11/08* (2006.01)

(52) U.S. Cl. ..... 187/249; 187/257; 187/258; 187/266

(58) Field of Classification Search ..... 187/257, 187/258, 249, 251, 254, 404, 264, 266; 254/278, 254/290

See application file for complete search history.

(56) References Cited

U.S. PATENT DOCUMENTS

| | | | | | |
|---|---|---|---|---|---|
| 931,962 | A | * | 8/1909 | Rountree | 5/10.2 |
| 1,837,643 | A | * | 12/1931 | Anderson | 187/249 |
| 1,911,834 | A | | 5/1933 | Lindquist | |
| 4,591,025 | A | * | 5/1986 | Honda | 187/266 |
| 4,753,322 | A | * | 6/1988 | Yasuda | 187/254 |
| 4,756,388 | A | * | 7/1988 | Heikkinen | 187/266 |
| 5,699,879 | A | * | 12/1997 | Sakita | 187/249 |
| 5,871,070 | A | * | 2/1999 | Contreras | 187/263 |
| 6,247,557 | B1 | * | 6/2001 | Kobayashi et al. | 187/266 |

FOREIGN PATENT DOCUMENTS

| | | | |
|---|---|---|---|
| DE | 3744078 | A * | 7/1989 |
| EP | 1 329 412 | A1 | 7/2003 |
| EP | 1 700 809 | A | 9/2006 |

* cited by examiner

*Primary Examiner*—John Q Nguyen
*Assistant Examiner*—Stefan Kruer
(74) *Attorney, Agent, or Firm*—Fraser Clemens Martin & Miller LLC; William J. Clemens

(57) ABSTRACT

An elevator system has a lower elevator car, an upper elevator car and a counterweight. A first drive drives the lower elevator car and a second drive drives the upper elevator car. Two parallelly extending guide rails lying in the region of a vertical center plane guide the elevator cars. A support device for the elevator cars and the counterweight comprises two separate support strands. The lower elevator car is fixed at two substantially diagonally opposite points of a horizontal plane each at a respective end of one of the support strands. The upper elevator car is similarly fixed at two substantially diagonally opposite points of a horizontal plane each at an end of one of the support strands, wherein the two diagonals intersect.

14 Claims, 5 Drawing Sheets

DUAL-CAR ELEVATOR SYSTEM WITH COMMON COUNTERWEIGHT

CROSS-REFERENCE TO RELATED APPLICATION

This application claims the benefit of U.S. provisional patent application Ser. No. 60/870,196 filed Dec. 15, 2006.

FIELD OF THE INVENTION

The present invention relates to an elevator system with a lower elevator car, an upper elevator car, a counterweight, a first drive for driving the lower elevator car, a second drive for driving the upper elevator car, two parallelly extending guide rails which lie in the region of a vertical center plane and between which the lower elevator car and the upper elevator car are guided, and a support means for the elevator cars and the counterweight.

BACKGROUND OF THE INVENTION

Elevator systems of the kind described above are known per se, for example from patent document EP 1 329 412 A1. The elevator system described there has two elevator cars in a common elevator shaft, each with a respective drive and with only one, common counterweight.

It is disadvantageous with this known system that inter alia each of the elevator cars, due to the special suspension, is not balanced. This can have the consequence of friction and wear at the guide rails if the elevator cars are asymmetrically loaded. Moreover, audible or detectable knocks occur during travel.

It is an object of the present invention to propose an elevator system of the kind described above by which the disadvantages of the state of the art systems are avoided.

SUMMARY OF THE INVENTION

According to the present invention this object is fulfilled with an elevator system having a lower elevator car, an upper elevator car, a counterweight, a first drive for driving the lower elevator car, a second drive for driving the upper elevator car, two parallelly extending guide rails which lie in the region of a vertical center plane and between which the lower elevator car and the upper elevator car are guided, and a support means for the elevator cars and the counterweight. The support means comprises a first support means strand with a first and a second end and a second support means strand with a first and a second end, wherein the lower elevator car is suspended on a first side of the center plane and a first side of a second vertical center plane, which is oriented perpendicularly to the first center plane, at the first end of the first support means strand and on the second side of the first center plane and the second side of the second center plane at the first end of the second support means strand. The upper elevator car is suspended on the first side of the first center plane and the second side of the second center plane at the second end of the first support means strand and on the second side of the first center plane and the first side of the second center plane at the second end of the second support means strand.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
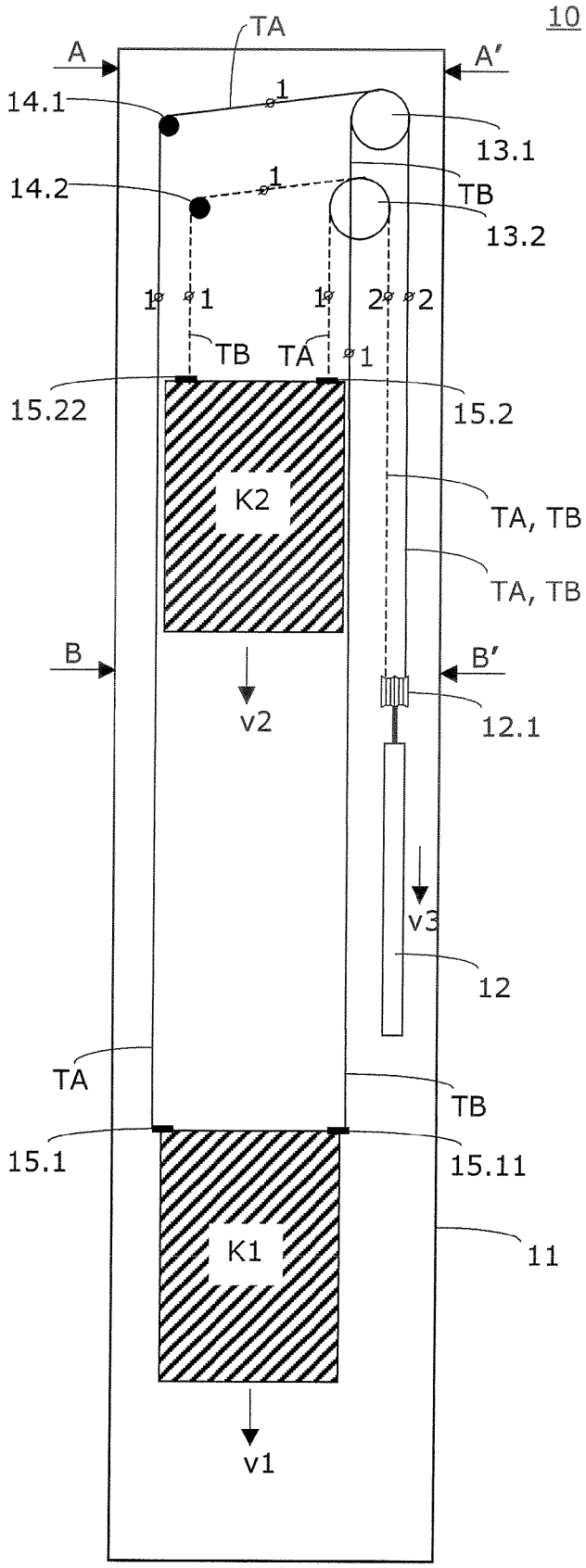
FIG. 1A is a schematic side elevation view of a first of embodiment of an elevator system according to the present invention.

The U.S. provisional patent application Ser. No. 60/870,196 filed Dec. 15, 2006 is hereby incorporated herein by reference.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

The following generally applies to the drawing and the further description:

- The figures are not to be regarded as true to scale.
- The same or similar constructional elements, or constructional elements with the same or similar function, are provided in all figures with the same reference numerals.
- Statements such as right, left, above, below refer to the respective arrangement in the figures.
- Deflecting rollers and deflecting auxiliary rollers are illustrated in sections generally perpendicular to their axes of rotation as black circles.
- Drive pulleys are illustrated generally in sections perpendicular to their axes of rotation as circular or oval lines.
- Those parts or runs of support means strands and tensioning means strands, which are disposed between one of the elevator cars and an upper counterweight deflecting roller, are illustrated by lines differently from those parts of the support means strands and tensioning means strands which are disposed between the other elevator car K2 and the upper counterweight deflecting roller.

It is additionally indicated for each run by a usual diameter signature and with one of the numerals "1" and "2" whether the corresponding locations respectively relate to a support means strand or tensioning means strand or two support means strands or tensioning means strands; moreover it is indicated which support means strands or tensioning means strands are concerned.

Looping angle of flexible support means strands around drive pulleys are in general indicated in multiples of 90°, even when these looping angles slightly depart from the indicated values. The looping angles can be substantially influenced by the number, dimension and position of the deflecting rollers. The statements with respect to these parameters of the deflecting rollers in the following description and drawings are therefore to be regarded as examples.

Figure 1B:
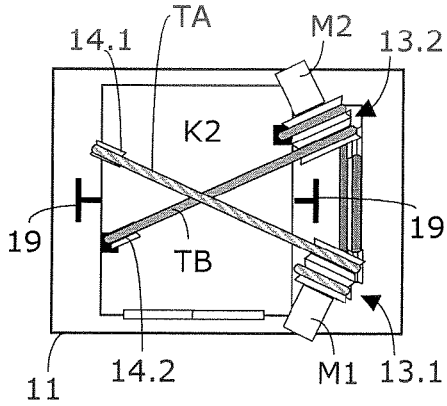
FIG. 1B is a view taken along the line A-A' in FIG. 1A.
Figure 1C:
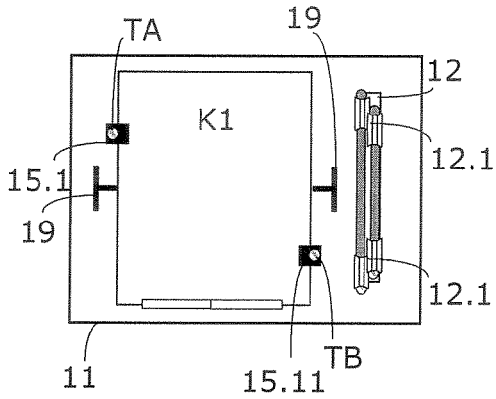
FIG. 1C is a view in section along the line B-B' in FIG. 1A.

FIGS. 1A, 1B and 1C show a first embodiment of an elevator system 10 according to the present invention. These are schematic views on the basis of which the fundamental elements of the invention are explained. A lower elevator car K1 and an upper elevator car K2 of the new elevator system 10 are disposed one above the other in a common elevator shaft 11, in which they can move independently of one another.

A common counterweight 12 is additionally disposed in the elevator shaft 11. The counterweight 12 is suspended at an upper counterweight deflecting roller arrangement 12.1 in a so-termed 2:1 suspension. A roller arrangement with more than one roller is also to be understood by the term counterweight deflecting roller. A speed of the lower elevator car K1 is indicated by "v1", a speed of the upper elevator car K2 by "v2", and a speed of the counterweight 12 by "v3".

A first drive M1 for the lower elevator car K1 and a second drive M2 for the upper elevator car K2 are disposed in the upper region of the elevator shaft 11. A first drive pulley 13.1 is coupled with the first drive M1 and a second drive pulley 13.2 is coupled with the second drive M2.

In addition, a first deflecting roller 14.1 is associated with the lower elevator car K1 and a second deflecting roller 14.2 is associated with the upper elevator car K2, the two deflecting rollers being located in the upper region of the elevator shaft 11.

The lower elevator car K1 has, in its upper region, a first fastening point 15.1 on the left and a second fastening point 15.11 on the right. The upper elevator car K2 similarly has, in its upper region, a third fastening point 15.2 on the right and a fourth fastening point 15.22 on the left. The elevator cars K1 and K2 are suspended in a so-termed 1:1 suspension at flexible support means TA, TB, as is described in more detail below.

The support means substantially consist of a first support means strand TA and a second support means strand TB, each of which has a first and a second end. The support means strands TA, TB are fixed to the elevator cars K1 and K2 at the fastening points 15.1, 15.11, 15.2, 15.22 in such a manner that each of the elevator cars K1 and K2 is suspended at each of the support means strands TA and TB. Advantageously each of the support means strands TA and TB is formed by two or more parallel support means elements, such as, for example, by two belts or two cables. Each support means strand TA and TB can, however, also comprise only one belt or one cable. The supporting structure of these support means strands TA and TB is advantageously made of steel, aramide or Vectran (a registered trademark of CNA Holdings, Inc. of Summit, N.J.) material.

The first support means strand TA is fastened by its first end at the first fastening point 15.1 to the lower elevator car K1, runs from there upwardly to the first deflecting roller 14.1 and further to the right to the first drive pulley 13.1, around which it is led with a looping angle of at least 90°.

The second support means strand TB is fastened by its first end at the second fastening point 15.11 to the lower elevator car K1 and runs from there upwardly to the first drive pulley 13.1, around which it is led with a looping angle of at least 180°.

The two support means strands TA and TB run from the drive pulley 13.1 together in parallel downwardly to the upper counterweight deflecting roller 12.1, where they are deflected through 180°.

From the upper counterweight roller 12.1 the two support means strands TA and TB run together upwardly in upward direction to the second drive pulley 13.2. The first support means strand TA is led with a looping angle of at least 180° around the second drive pulley 13.2. The second support means strand TB is led with a looping angle of at least 90° around the second drive pulley 13.2. From the second drive pulley 13.2 the first support means strand TA runs downwardly to the third fastening point 15.2 at the upper elevator car K2, at which its second end is fastened. Similarly, from the second drive pulley 13.2 the second support means strand TB runs to the left to the deflecting roller 14.2 and then to the fourth fastening point 15.22 at the upper elevator car K2, at which its second end is fastened.

Figure 6:
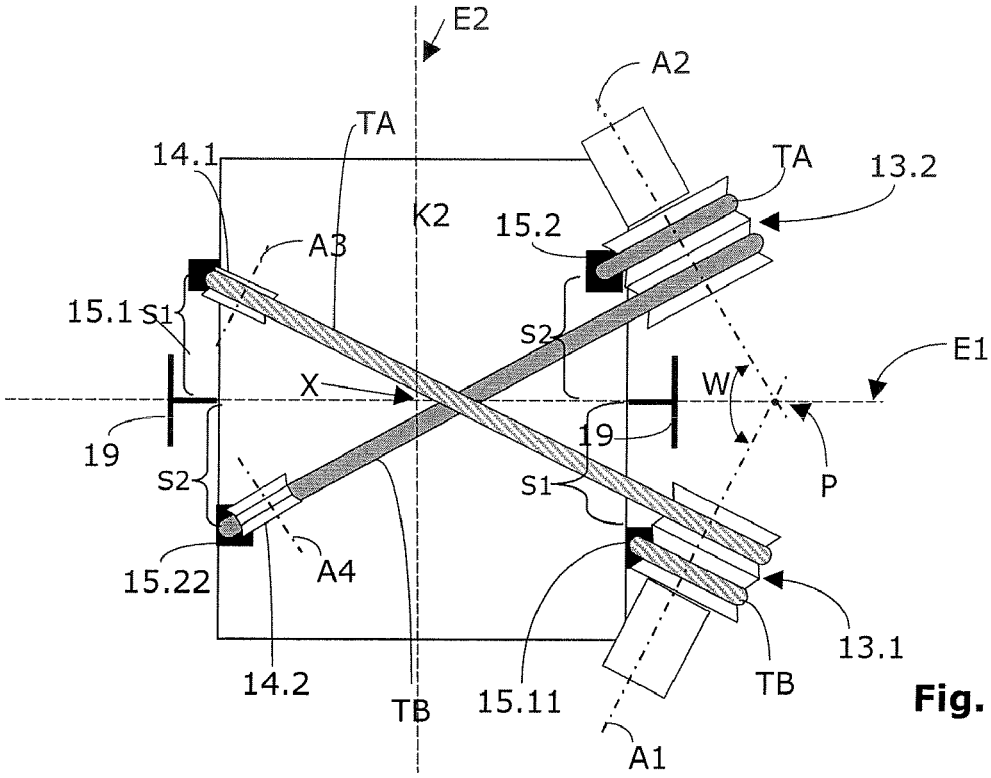
FIG. 6 shows FIG. 1B with further details, in an enlarged illustration.

FIGS. 1C and 6 show how the force introduction takes place through the support means strands TA and TB for each of the elevator cars K1 and K2 at least approximately centrally symmetrical in such a manner that a tendency of the elevator cars to tip about a horizontal tip axis lying in the center plane E1 is counteracted. This form of suspension is here also termed balanced suspension, which is to ensure that even in the case of asymmetrical loading of the elevator cars K1 and K2 a tipping of the same is prevented or that the degree of tipping is kept within manageable limits.

FIGS. 1A, 2, 3A, 4 and 5 show an advantageous arrangement of the drive pulleys 13.1 and 13.2 in the uppermost region of the elevator shaft. The drive pulleys 13.1 and 13.2 are arranged vertically, i.e. with horizontal axes A1 and A2, as apparent from FIG. 6.

A particularly favorable arrangement with a conflict-free guidance of the support means strands TA and TB is obtained by arranging the drives M1 and M2 to be offset in height one above the other, wherein the offset advantageously at least corresponds with the radius of the drive pulleys 13.1 and 13.2.

In the case of the arrangement described above with reference to FIGS. 1A, 1B and 1C the support means strands TA, TB to a certain extent exchange their places, i.e. the support means strand TA is fastened to the lower elevator car K1 on the left and to the upper elevator car K2 on the right and the support means strand TB is fastened to the lower elevator car K1 on the right and to the upper elevator car K2 on the left. It is thus achieved that the overall lengths of the two support means strands TA, TB are not significantly different, which is advantageous with respect to their behavior, particularly thermal expansion and resilient stretching. However, the support means strands TA, TB can also be arranged uncrossed.

A guide device for the vertical guidance of the cars K1 and K2 in the elevator shaft 11 comprises two stationary guide rails 19 which extend vertically along opposite sides of the elevator shaft 11 and are fastened in a manner which is not illustrated. The guide device additionally comprises guide bodies, which are not illustrated. Two guide bodies which co-operate with the respective guide rails 19 are preferably fastened in vertically aligned arrangement at both sides at each of the elevator cars K1 and K2. The guide bodies at each side of the cars K1 and K2 are advantageously mounted at a largest possible vertical spacing.

The configuration according to the present invention is such that the counterweight 12 is arranged in the region of one of the guide rails 19 and moves, with vertical guidance, similarly along this guide rail 19 at counterweight guide rails (not shown), wherein the guide rail 19 is arranged between the cars K1 and K2 on the one hand and the counterweight 12 on the other hand.

Figure 2:
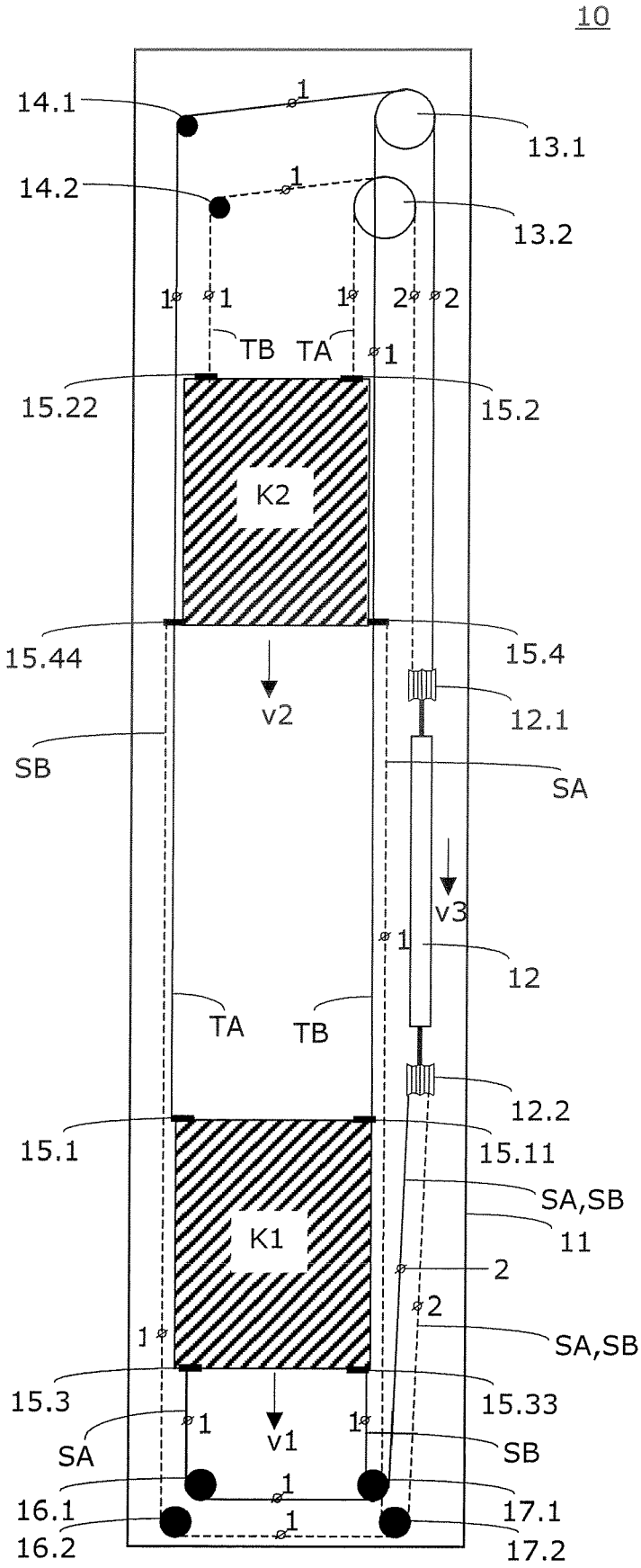
FIG. 2 is a schematic side elevation view of a second embodiment of an elevator system according to the present invention with additional tensioning means.

FIG. 2 shows a second embodiment of the present invention. This comprises all constructional elements described with reference to FIGS. 1A, 1B and 1C as well as an additional device (also known as compensating cable tensioning device (ASS)) in order to better tension the support means strands TA and TB and to better guide the elevator cars K1 and K2 as well as the counterweight 12.

The elevator system 10 according to FIG. 2 comprises for this purpose a lower counterweight deflecting roller 12.2 which is suspended at the bottom at the counterweight 12. A fifth fastening point 15.3 is disposed at the lower region of the lower elevator car K1 at the left bottom and a sixth fastening point 15.33 at the right bottom. A seventh fastening point 15.2 is disposed at the lower region of the upper elevator car K2 at the right bottom and an eighth fastening point 15.44 at the left bottom.

Moreover, two deflecting rollers, which are termed first auxiliary roller 16.1 and second auxiliary roller 16.2, are located in the lower region of the shaft 11 on the left. Moreover, two further deflecting rollers are provided, which are termed third auxiliary roller 17.1 and fourth auxiliary roller 17.2. In addition, the elevator system 10 according to FIG. 2 comprises tensioning means which substantially consist of a first tensioning means strand SA and a second tensioning means strand SB.

The first tensioning means strand SA is fastened by its first end at a fifth fastening point 15.3 of the lower elevator car K1 and runs from there around the auxiliary rollers 16.1 and 17.1. The second tensioning means strand SB is fastened at its first end at the sixth fastening point 15.33 of the lower elevator car K1 and runs from there around the auxiliary roller 17.1. The two tensioning means strands SA and SB then run together from the deflecting roller 17.1 to the lower counterweight deflecting roller 12.2, where they are deflected and subsequently led together to the auxiliary roller 17.2. Going out from the auxiliary roller 17.2 the first tensioning means strand SA runs upwardly to the seventh fastening point 15.4 of the upper elevator car K2. Similarly, going out from the auxiliary roller 17.2 the second tensioning means strand SB runs to the auxiliary roller 16.2 and from there upwardly to the eighth fastening point 15.44 of the upper elevator car K2. The statement made with respect to the change of place of the support means strands TA and TB with regard to FIG. 1 equally applies to a crossing of the tension means strands SA and SB.

Advantageously, each of the tensioning means strands SA, SB is formed by two or more parallel tensioning means elements, such as, for example, by two belts or two cables. Each tensioning means strand SA, SB can, however, comprise only one belt or one cable. The supporting structure of these support means strands SA, SB is advantageously made of steel, aramide or Vectran material.

Tensioning aids are preferably provided in or at the shaft 11 in the region of the tensioning means strands SA, SB so as to be able to mechanically tension the tensioning means strands SA, SB. These tensioning aids are not shown in the figures.

Figure 3A:
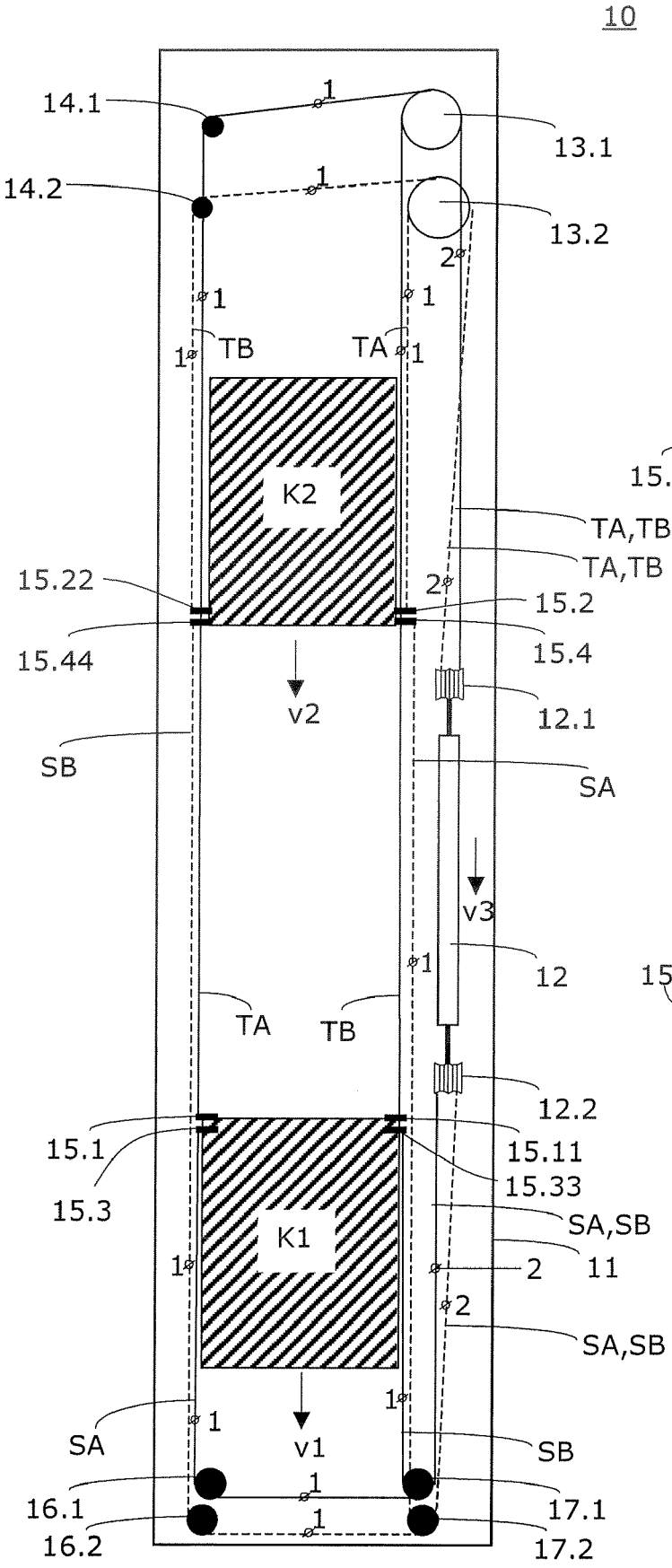
FIG. 3A is a schematic side elevation view of a third embodiment of an elevator system according to the present invention with fastening regions for the support means strands and tensioning means stands in the same region of the car, for the upper car in the lower region and for the lower car in the upper region.
Figure 3B:
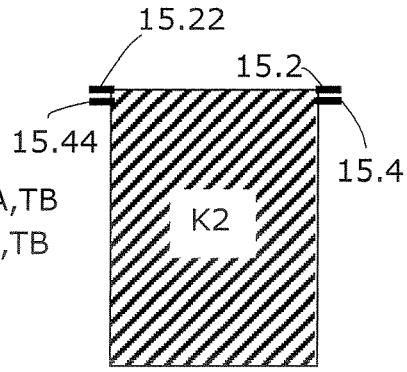
FIG. 3B shows the upper car illustrated in FIG. 3A, but with fastening regions for the support means strands and tensioning means strands in the upper region of the car.

The first and second fastening regions 15.1, 15.11 as well as the fifth and sixth fastening regions 15.3, 15.33 are either located each on a lower region or an upper region of the car K1, as shown in FIG. 2, or in common in the lower or upper region of the car K1, as shown in FIGS. 3A and 3B. If the first and second fastening regions 15.1, 15.11 are located in the upper region of the car K1 and the fifth and sixth fastening regions 15.3, 15.33 in the lower region of the car K1 then the advantage resides in the use of shorter support means strands TA, TB. In principle, a reverse arrangement of the first and second fastening regions 15.1, 15.11 in the lower region and the fifth and sixth fastening regions 15.3, 15.33 in the upper region of the car K1 is also possible. If the first and second fastening regions 15.1, 15.11 together with the fifth and sixth fastening regions 15.3, 15.33 are located in the lower or upper region of the car K1 the advantage resides in the simple construction of the car K1. The force-introducing structure then substantially consists of a single beam.

Figure 3C:
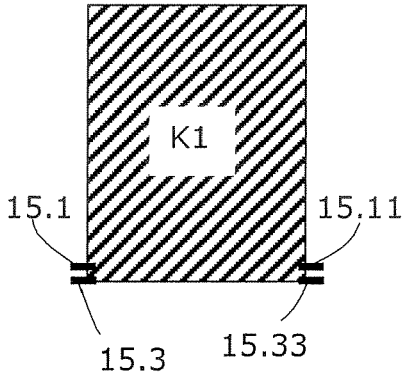
FIG. 3C shows the lower car illustrated in FIG. 3A, but with fastening regions for the support means strands and tensioning means strands in the lower region of the car.

Analogous arguments also apply to the third, fourth, seventh and eighth fastening regions 15.2, 15.22, 15.4, 15.44, which are located either in common in the upper or lower region of the car K2, as shown in FIGS. 3A and 3C, or each in an upper region or lower region B2 of the car K2, as shown in FIG. 2. If the seventh and eighth fastening regions 15.4, 15.44 are located in the lower region B2 of the car K2 and the third and fourth fastening regions 15.2, 15.22 in the upper region of the car K2 the advantage resides in the use of shorter tensioning means strands SA, SB. In principle, a reverse arrangement of the third and fourth fastening regions 15.2, 15.22 in the lower region and the seventh and eighth fastening regions 15.4, 15.44 in the upper region of the car K2 is also possible. If the seventh and eighth fastening regions 15.4, 15.44 together with the third and fourth fastening regions 15.2, 15.22 are located in the upper or lower region of the car K2 the advantage resides in the simple construction of the car K1. The force-introducing construction then substantially consists of a single beam.

Figure 4:
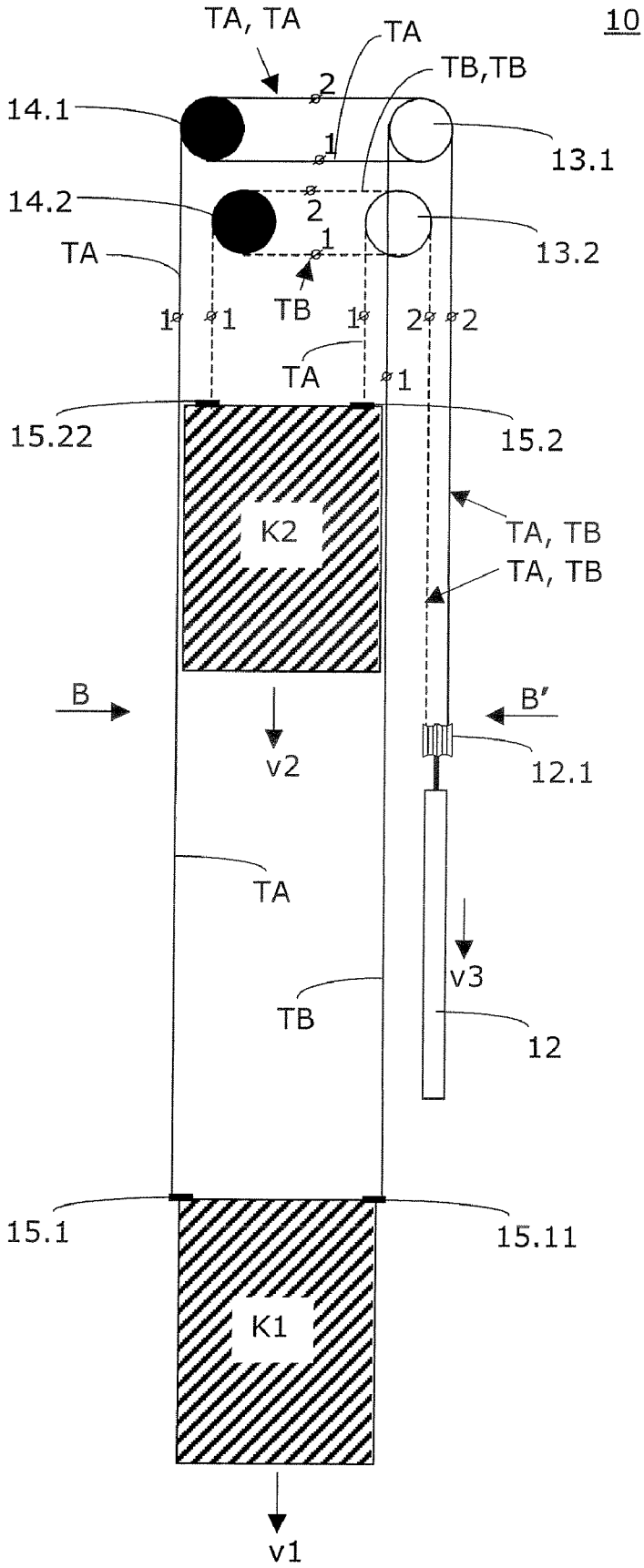
FIG. 4 is a schematic side elevation view of a fourth embodiment of an elevator system according to the present invention with enlarged looping angle of the support means strands about the drive pulleys.
Figure 5:
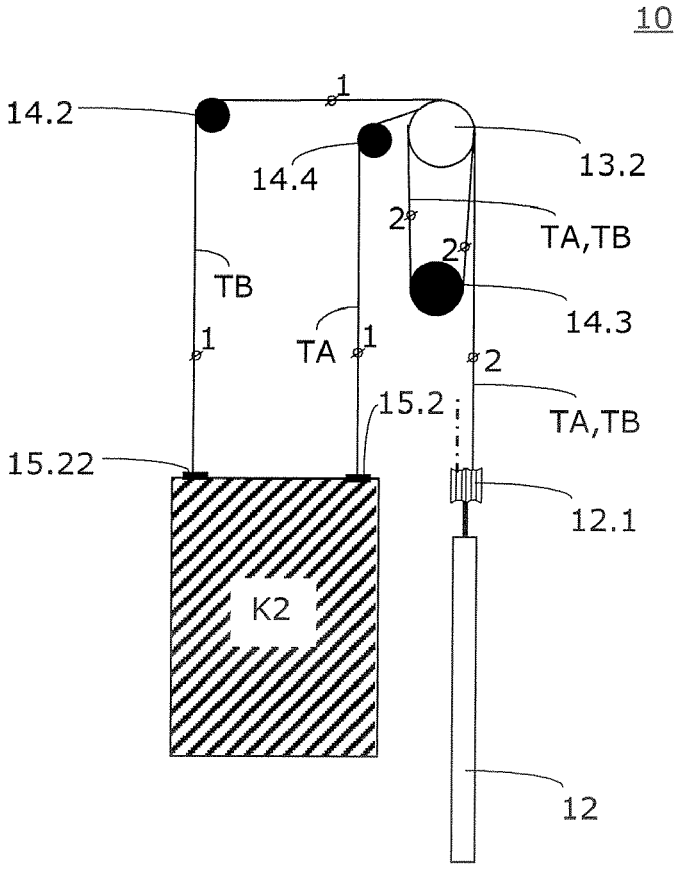
FIG. 5 is a schematic side elevation view of a fifth embodiment of an elevator system according to the present invention, similarly with enlarged looping angle of the support means strands around the drive pulleys.

The forms of positioning, which are shown in FIGS. 2, 3A, 3B and 3C, of the fastening regions 15 are also analogously usable for the following examples of embodiment shown in FIGS. 4 and 5. In addition, it will be clear to the expert that the examples of embodiment of FIGS. 4 and 5 can similarly be equipped with an ASS system according FIGS. 2, 3A, 3B, 3C.

FIG. 4 shows an embodiment similar to FIG. 1, in fact without the shaft 11, but with a different guidance of the support means strands TA and TB in order to improve the traction thereof or in order to ensure the traction thereof by a looping angle of the support means strands TA, TB around the drive pulleys of more than 90° and preferably from 180° to 270°.

For this purpose, according to FIG. 4 the first support means strand TA runs upwardly from the first fastening point 15.1 to the lower elevator car K1 and around the deflecting roller 14.1 and from there to the right to the first drive pulley 13.1. The first support means strand TA is then led in a first looping phase, as in the case of the arrangement according to FIG. 1, through 90° and subsequently through a further 90° around the first drive pulley 13.1. From there it passes to the left and thus back to the deflecting roller 14.1 and from this again to the right to the first drive pulley 13.1, around which it is now guided in a second looping phase once more along at least 90°. The entire looping angle of the first support means strand TA around the first drive pulley 13.1, which according to FIG. 1 is 90°, is now, according to FIG. 4, 270°. Of that, 180° are apportioned to the first looping phase and 90° to the second looping phase. From the first drive pulley 13.1 the first support means strand TA runs downwardly to the counterweight deflecting roller 12.1 and subsequently upwardly to the second drive pulley 13.2. The first support means strands TA is then led 180° around the drive pulley 13.2 and finally passes to the third fastening point 15.2 at the upper elevator car K2.

The second support means strand TB runs from the second fastening point 15.11 at the lower elevator car K1 around the first drive pulley 13.1, wherein its looping angle around the first drive pulley 13.1 is 180°. Going out from the first drive pulley 13.1 the second support means strand TB runs, together with the first support means strand TA, to the upper counterweight deflecting roller 12.1 and from this upwardly to the second drive pulley 13.2. There the second support means strand TB is led in a first looping phase with a looping angle of 90° around the second drive pulley 13.2. From the second drive pulley 13.2 the second support means strand TB then passes to the left to the deflecting roller 14.2, where it is deflected through 180° and is thus led back to the right to the second drive pulley 13.2. Here it is led in a second looping phase once more around the drive pulley 13.2 and, in particular, this time with a looping angle of 180°. In addition, it is led once again to the left to the deflecting roller 14.2 and from this it finally goes downwardly to the fourth fastening point 15.22 of the upper elevator car K2. The entire looping angle of the second support means strand TB around the second drive pulley 13.2, which according to FIG. 1 is 90°, is now, according to FIG. 4, 270°. Of that, 90° are apportioned to the first looping phase and 180° to the second looping phase.

FIG. 5 shows a further embodiment of the new elevator system 10 in which similarly, as according to FIG. 4, looping angles around the drive pulleys 13.1, 13.2 by more than 90° are achieved, wherein this is shown in FIG. 5 merely with respect to the upper elevator car K2 and the second drive pulley 13.2. The upper elevator car K2, the counterweight 12 with the upper counterweight deflecting roller 12.1, the deflecting roller 14.2, the drive pulley 13.2 and those runs of the support means strands TA and TB which are disposed on the one hand between the fastening points 15.2 and 15.22 and the upper counterweight deflecting roller 12.1 are illustrated. The form of embodiment shown in FIG. 5 comprises additional deflecting rollers 14.3 and 14.4.

The first support means strand TA runs, going out from the third fastening point 15.2, upwardly to the deflecting roller 14.4 and further to the drive pulley 13.2, along which it is guided in a first looping phase through approximately 90°. From there the first support means strand TA runs downwardly, around the deflecting roller 14.3 and back to the drive pulley 13.2, along which it is now led in a second looping phase through approximately 180°. Overall, the support means TA thus encircles the drive pulley 13.2 by 270°. From the drive pulley 13.2 the support means strand TA runs downwardly to the counterweight deflecting roller 12.1.

The second support means strand TB runs, going out from the fourth fastening point 15.22 at the upper elevator car K2, upwardly to the deflecting roller 14.2 and further to the drive pulley 13.2, around which it is led in a first region phase through approximately 90°. From there the second support means strand TB runs downwardly, around the deflecting roller 14.3 and further to the drive pulley 13.2, along which it is now led in the second looping phase through approximately 180°. Overall the support means strand TB thus encircles the drive pulley 13.2 by 270°. The second support means strand TB, together with the first support means strand TA, subsequently runs downwardly to the counterweight deflecting roller 12.1. The further course of the support means strands TA and TB is not illustrated, but is clearly evident to any expert from the above description.

FIG. 6 is an enlarged illustration of FIG. 1B, in which details are shown which do not appear or are not clearly apparent in FIG. 1B. Illustrated are, in particular, the vertical center plane E1, which is defined by the two longitudinal axes of the guide rails 19, and the vertical center plane E2 oriented perpendicularly thereto. The two center planes E1 and E2 intersect at a vertical center axis, which is visible in FIG. 6 only as an uppermost point X.

Not only the first fastening point 15.1, but also the second fastening point 15.11 at the lower elevator car K1 are spaced from the first center plane E1 and, in particular, by paths s1 which are the same or at least approximately the same. The two fastening points 15.1, 15.11 lie on opposite sides of the first center plane E1 and the second center plane E2 in order to achieve the balanced suspension of the lower elevator car K1. They are preferably arranged rotationally symmetrically or at least approximately rotationally symmetrically with respect to a point on the vertical center axis. However, depending on the respective application a uniform spacing s1 in relation to the plane E1 suffices.

Equally, the third fastening point 15.2 and the fourth fastening point 15.22 at the upper elevator car K2 are spaced from the first center plane E1 and, in particular, by paths s2 which are the same or at least approximately the same. The two fastening points 15.2, 15.22 lie on opposite sides of the first center plane E1 and the second center plane E2 and in each instance also on different sides of the two center planes from the fastening points 15.1 and 15.11. This arrangement also achieves a balanced suspension. They are preferably arranged rotationally symmetrically or at least approximately rotationally symmetrically with respect to the point X on the vertical center axis. However, depending on the respective use a uniform spacing s2 with respect to the plane E1 suffices.

It is achieved by this special arrangement of the fastening points 15.1, 15.11 or 15.2, 15.22 that the elevator cars K1 and K2 are suspended in balanced manner in such a way that tipping movements of the elevator cars about horizontal tip axes, which lie in the vertical center plane E1, are largely prevented.

The first drive pulley 13.1 has a first axis A1 and the second drive pulley 13.2 a second axis A2. The deflecting roller 14.1 has a third axis A3 and the deflecting roller 14.2 a fourth axis A4.

The projections of the first axis A1 and the second axis A2 intersect at a point P on the first center plane E1 and include an angle W. This angle W preferably lies between 180 degrees and 90 degrees.

Due to the fact that the two cars K1, K2 are connected by way of common support means TA, TB with only one counterweight 12 and due to the special form of 1:1 suspension of the cars K1, K2 and the 2:1 suspension of the counterweight 12 different speeds "v1", "v2" and "v3" result according to the respective travel situation. If the car K1 moves upwardly at the speed "v1" while the car K2 is stationary the counterweight 12 then moves downwardly at v3=v1/2. If the car K2 moves downwardly at the speed "v2" while the car K1 is stationary the counterweight 12 then moves upwardly at v3=v2/2. If the cars K1, K2 move towards one another at the same speed v1=v2 then "v3" is equal to zero. If the car K1 and the car K2 move downwardly at the same speed v1=v2 the counterweight 12 then moves upwardly and v3=v1=v2.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator system including a lower elevator car, an upper elevator car, a counterweight, a first drive for driving the lower elevator car, a second drive for driving the upper elevator car, two parallelly extending guide rails which lie in a region of a vertical first center plane and between which the lower elevator car and the upper elevator car are guided, and a support means for the elevator cars and the counterweight, comprising:

a first support means strand of the support means with a first end and a second end; and a second support means strand of the support means with a first end and a second end, said first and second ends of said first and second support means strands each being fastened to one of the lower elevator car and the upper elevator car at first through fourth fastening points, wherein the lower elevator car is suspended on a first side of the vertical first center plane and on a first side of a vertical second center plane oriented perpendicularly to the vertical first center plane at said first end of said first support means strand and on a second side of the vertical first center plane and a second side of the vertical second center plane at said first end of said second support means strand, and wherein the upper elevator car is suspended on the first side of the vertical first center plane and the second side of the vertical second center plane at said second end of said first support means strand and on the second side of the vertical first center plane and the first side of the vertical second center plane at said second end of said second support means strand, wherein said first support means and said second support means cross above the upper elevator car.

2. The elevator system according to claim 1 wherein in one of an upper region and a lower region of the lower elevator car said first end of said first support means strand is fastened at said first fastening point and said first end of said second support means strand is fastened at said second fastening point, and wherein spacings of said first and second fastening points from the vertical first center plane are approximately equal.

3. The elevator system according to claim 1 wherein said first support means strand, starting from said first fastening point at the lower elevator car, runs upwardly over a first deflecting roller, from said first deflecting roller laterally over a first drive pulley that is driven by the first drive, downwardly to an upper counterweight deflecting roller that supports the counterweight, upwardly around a second drive pulley that is driven by the second drive, and downwardly to said third fastening point at the upper elevator car, wherein a section of said first support means strand disposed between said first fastening point and said first deflecting roller is led laterally past the upper elevator car, and said second support means strand starting from said second fastening point at the lower elevator car, runs upwardly around said first drive pulley that is driven by the first drive, from said first drive pulley downwardly to said upper counterweight deflecting roller, upwardly around said second drive pulley, laterally to a second deflecting roller, and downwardly to said fourth fastening point at the upper elevator car, wherein a section of said second support means strand disposed between said second fastening point and said first drive pulley is led laterally past the upper elevator car.

4. The elevator system according to claim 1 wherein said first and second support means strands loop around drive pulleys of the first and second drives in two looping phases by more than 180°.

5. The elevator system according to claim 1 including tensioning means that exert a downwardly directed tension force on the first and second elevator cars.

6. The elevator system according to claim 1 wherein said first and second support means strands are formed from cables or belts.

7. The elevator system according to claim 2 wherein said first fastening point and said second fastening point lie laterally adjacent to the lower elevator car in order to guide said first support means strand, starting from said first fastening point, and said second support means strand, starting from said second fastening point, upwardly and laterally past the upper elevator car.

8. The elevator system according to claim 2 wherein in one of an upper region and a lower region of the upper elevator car said second end of said first support means strand is fastened at said third fastening point and said second end of said second support means strand is fastened at said fourth fastening point, wherein spacings of said third and fourth fastening points from the vertical first center plane are approximately equal.

9. The elevator system according to claim 4 wherein said first support means strand, staffing from said first fastening point at the lower elevator car, is deflected by a first deflecting roller and loops around a first of said drive pulleys by 90° in a first looping phase, loops around said first drive pulley in said first looping phase by a further 90°, runs to said first deflecting roller and back to said first drive pulley, and loops around said first drive pulley in a second looping phase by 90°, and wherein said second support means strand, starting from said fourth fastening point at the upper elevator car, is deflected by a second deflecting roller and loops around a second of said drive pulleys by 90° in a first looping phase, loops around said second drive pulley in said first looping phase by a further 90°, runs to said second deflecting roller and back to said second drive pulley, and loops around said second drive pulley in said second looping phase by 90°.

10. The elevator system according to claim 9 including a third deflecting roller for deflection of said first and second support means strands and a fourth deflecting roller for deflection of said first support means strand, wherein said first support means strand, starting from said third fastening point at the upper elevator car, is led by said fourth deflecting roller to said second drive pulley, loops around said second drive pulley in a first looping phase by 90°, runs to said third deflecting roller and back to said second drive pulley, and loops around said second drive pulley in a second looping phase by at least 180°, and wherein said second support means strand, starting from said fourth fastening point, runs to said second deflecting roller and, after looping around said second drive pulley by 90° in a first looping phase, runs to said third deflecting roller and back to said second drive pulley, and loops around said second drive pulley in a second looping phase by at least 180°.

11. The elevator system according to claim 5 wherein said tensioning means include a first tensioning means strand with a first end and a second end, a second tensioning means stand with a first and a second end, a fifth fastening point at a lower region of the lower elevator car fastened to said first end of said first tensioning means strand, a sixth fastening point at the lower region of the lower elevator car fastened to said first end of said second tensioning means strand, a seventh fastening point at a lower region of the upper elevator car fastened to said second end of said first tensioning means strand, an eighth fastening point at the lower region of the upper elevator car fastened to said second end of said second tensioning means strand, first through fourth deflecting auxiliary rollers and a lower counterweight deflecting roller that is suspended at the counterweight, wherein said first tensioning means strand runs from said fifth fastening point at the lower elevator car downwardly and around said first auxiliary roller, laterally and around said third auxiliary roller, upwardly and around said lower counterweight deflecting roller, downwardly and around said fourth auxiliary roller, and upwardly to said seventh fastening point at the upper elevator car, wherein said second tensioning means strand runs from said sixth fastening point at the lower elevator car downwardly and around said third auxiliary roller, upwardly and around said lower counterweight deflecting roller, downwardly and around said fourth auxiliary roller, laterally and around said second auxiliary roller, and upwardly to said eighth fastening point at the upper elevator car, and wherein a section of said first support means strand running between said seventh Fastening point at the upper elevator car and said fourth auxiliary roller as well as a section of said second tensioning means strand running between said eighth fastening point and said second auxiliary roller are led laterally past the lower elevator car.

12. The elevator system according to claim 11 wherein said first and second tensioning means strands are formed from cables or belts.

13. An elevator system including a lower elevator car, an upper elevator car, a counterweight, a first drive for driving the lower elevator car, a second chive for driving the upper elevator car, two parallelly extending guide rails which lie in a legion of a vertical first center plane and between which the lower elevator car and the upper elevator car are guided, and a support means for the elevator cars and the counterweight, comprising:

a first support means stand of the support means with a first end and a second end; and a second support means strand of the support means with a first end and a second end, said first and second ends of said first and second support means strands each being fastened to one of the lower elevator car and the upper elevator car at first through fourth fastening points, wherein the lower elevator car is suspended on a first side of the vertical first center plane and on a first side of a vertical second center plane oriented perpendicularly to the vertical first center plane at said first end of said first support means strand and on a second side of the vertical first center plane and a second side of the vertical second center plane at said first end of said second support means strand, wherein the upper elevator car is suspended on the first side of the vertical first center plane and the second side of the vertical second center plane at said second end of said first support means strand and on the second side of the vertical first center plane and the first side of the vertical second center plane at said second end of said second support means strand, wherein said first support means strand, starting from said first fastening point at the lower elevator car, is deflected by a first deflecting roller and loops around a first of said drive pulleys by 90° in a first looping phase, loops around said first drive pulley in said first looping phase by a further 90°, runs to said first deflecting roller and back to said first drive pulley, and loops around said first chive pulley in a second looping phase by 90°, and wherein said second support means strand, starting from said fourth fastening point at the upper elevator car, is deflected by a second deflecting roller and loops around a second of said drive pulleys by 90° in a first looping phase, loops around said second drive pulley in said first looping phase by a further 90°, nuts to said second deflecting roller and back to said second drive pulley, and loops around said second drive pulley in said second looping phase by 90°, wherein said first support means and said second support means cross above the upper elevator car.

14. The elevator system according to claim 13 including a third deflecting roller for deflection of said first and second support means strands and a fourth deflecting roller for deflection of said first support means strand, wherein said first support means strand, starting from said third fastening point at the upper elevator car, is led by said fourth deflecting roller to said second drive pulley, loops around said second drive pulley in a first looping phase by 90°, runs to said third deflecting roller and back to said second drive pulley, and loops around said second drive pulley in a second looping phase by at least 180°, and wherein said second support means strand, starting from said fourth fastening point, runs to said second deflecting roller and, after looping around said second drive pulley by 90° in a first looping phase, runs to said third deflecting roller and back to said second drive pulley, and loops around said second drive pulley in a second looping phase by at least 180°.

* * * * *